United States Patent [19]

Yokogawa et al.

[11] Patent Number: 4,757,322

[45] Date of Patent: Jul. 12, 1988

[54] MOBILE ANTENNA UNIT

[75] Inventors: Tomohisa Yokogawa; Shintaro Gomi, both of Saitama, Japan

[73] Assignee: Pioneer Electronic Corporation, Tokyo, Japan

[21] Appl. No.: 780,112

[22] Filed: Sep. 25, 1985

[30] Foreign Application Priority Data

Sep. 29, 1984 [JP] Japan ..... 59-204941

[51] Int. Cl.[4] ..... H01Q 1/32; H01Q 1/40

[52] U.S. Cl. ..... 343/712; 343/713; 343/789; 343/825

[58] Field of Search ..... 343/712, 713, 715, 718, 343/749, 789, 816, 818, 825, 905, 908, 700 R, 705–711

[56] References Cited

U.S. PATENT DOCUMENTS 3,414,902 12/1968 Shaw, Jr. ..... 343/713

4,602,260 7/1986 Lindenmeier et al. ..... 343/713

FOREIGN PATENT DOCUMENTS 1333381 10/1973 United Kingdom ..... 343/713

*Primary Examiner*—Marvin L. Nussbaum

*Attorney, Agent, or Firm*—Sughrue, Mion, Zinn, Macpeak, and Seas

[57] ABSTRACT

A mobile antenna unit for use in the FM broadcast band which is adapted to be mounted on the windshield of the vehicle and which provides a gain and directivity pattern similar to those of an external whip antenna. The antenna element takes the form of a conductor mounted near one of the pillars supporting the windshield. The pillar appears electrically as an inductor and the conductor as a capacitor. By properly dimensioning and spacing the conductor with respect to the pillar, resonance is achieved in the FM broadcast band.

17 Claims, 15 Drawing Sheets

MOBILE ANTENNA UNIT

BACKGROUND OF THE INVENTION

The present invention relates to an antenna unit suitable as a main antenna for receiving FM broadcast signals in an automobile, or a so-called "sub-antenna" in an antenna diversity receiving system. More particularly, the invention relates to an antenna unit whose antenna element is mounted on a glass plate of an automobile.

A typical example of a conventional FM broadcast signal receiving antenna for an automobile is a whip antenna adapted to be installed on the front part, the roof, or the trunk of an automobile, as indicated at 17, 18 or 19 of FIG. 4. Recently, however, an antenna unit which is installed by the utilization of the rear window glass plate has been extensively employed.

In one example of an antenna unit of the latter type, as shown in FIG. 5, a heating wire 20 provided on the rear window glass plate for removing moisture, frost, etc., from the latter is also used as the antenna element. In another example, an antenna element 21 is provided on the portion of the glass plate where no heating wire is located. In a further example, the above-described two methods are employed in combination.

It has been disclosed in *Dempa Shimbun* (*Radio Wave Newspaper*), "High Technology", July 5, 1984, that a variety of antenna patterns have been applied to the front, rear and side window glass plates of an automobile.

Of the above-described conventional antennas, the whip antenna is excellent both in sensitivity and in directional pattern. However, since the whip antenna is, in general, maintained extended to about one meter outside the automobile, when the automobile passes through a car wash, it is necessary to retract or remove the antenna in advance. Furthermore, the whip antenna is disadvantageous in that while the automobile is running, the antenna produces a whistling sound. Also, the antenna may be stolen. Still further, it is rather difficult to install the antenna, and handling the whip antenna is troublesome when a sub-antenna is added in a diversity receiving system.

In the case of a window glass plate antenna unit, the antenna element is installed inside the vehicle. Therefore, employment of the window glass plate antenna unit can substantially eliminate the above-described difficulties. However, the antenna has a rather poor directional pattern. In addition, the antenna is much lower in sensitivity than a whip antenna having a length of the order of $\frac{1}{4}$ wavelength and which is installed outside the automobile.

The antenna unit installed on the rear window glass plate in which the antenna element also acts as the heating wire for the glass plate or the antenna unit in which the antenna element is close to the heating wire is disadvantageous in that it is liable to receive noise from electric power sources.

When an automobile receives an FM broadcast signal while travelling, it receives radio waves directly from the broadcasting antenna and radio waves reflected by the ground, buildings near the road, etc. Therefore, often multipath distortion is caused by the interference of these radio waves, as is well known in the art.

In order to eliminate the above-described difficulties, a signal receiving unit employing an antenna diversity system has been proposed and put to practical use. In such a signal receiving unit, a plurality of antennas are disposed at certain intervals with the directions of directivity being different from one another. In the signal receiving unit thus designed, the outputs of the plurality of antennas are monitored at all times and the antenna whose output is the highest is used, or when the output of the antenna presently in use decreases to a predetermined level, another antenna is used.

In the case of the above-described signal receiving unit of the antenna diversity system, at least two antennas must be provided. That is, in addition to the existing antenna, another antenna must be provided. In this case, it is desirable to use an antenna which is free from the above-described problems and is easy to install.

FIG. 19 shows a Smith chart on which a measured impedance characteristic of a whip antenna 90 cm in total length is drawn. The center of the chart (1.0) corresponds to the impedance (75 ohms) of the coaxial cable. The impedance of the antenna is a purely resistive 75 ohms substantially at the center frequency of the FM band.

FIG. 22 shows the directional pattern of a whip antenna when the latter receives vertically polarized waves, and FIG. 23 shows the directional pattern of the same antenna when the latter receives horizontally polarized waves.

FIGS. 10B, 11 and 12 show the impedance characteristics of the antenna measured by changing the length of the antenna element with the output part of the antenna secured to the upper left portion of the inner surface of the front window glass plate, as shown in FIG. 10A, and a copper foil 10 mm in width and 0.3 mm in thickness employed as the antenna element. As is apparent from these charts, the impedances are greatly shifted, and accordingly the antenna is low in sensitivity. In the case of FIG. 10B, the length of the antenna element was set to $\frac{1}{4}$ wavelength (90.4 cm). In the cases of FIGS. 11 and 12, the antenna element lengths were 1/7 wavelength (51.6 cm) and $\frac{1}{8}$ wavelength (45.2 cm), respectively.

SUMMARY OF THE INVENTION

Overcoming the drawbacks of the prior art whip and window-mounted antennas, the present invention provides an antenna unit for use in the FM broadcast band which is adapted to be mounted on the windshield of the vehicle and which provides a gain and directivity pattern similar to those of an external whip antenna. The antenna element takes the form of a conductor mounted near one of the pillars supporting the windshield. The pillar acts electrically as an inductor and the conductor as a capacitor. By properly dimensioning and spacing the conductor with respect to the pillar, resonance is achieved in the FM broadcast band.

DESCRIPTION OF THE PREFERRED EMBODIMENTS

Figure 1:
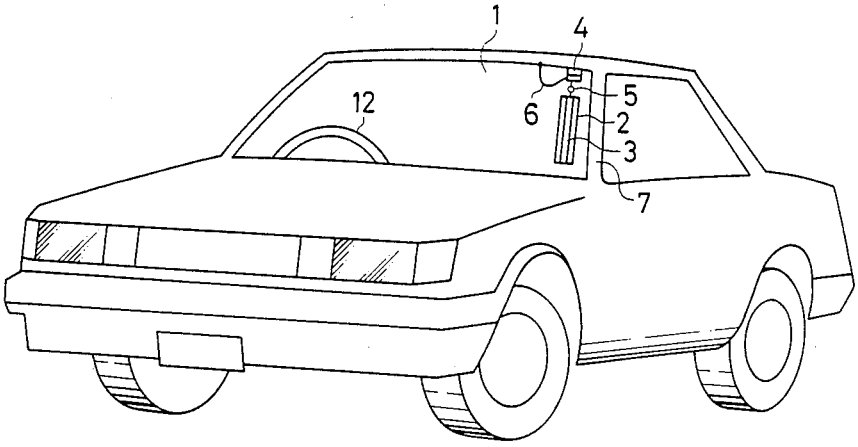
FIG. 1 is a diagram showing a preferred embodiment of an antenna unit of the invention.

FIG. 1 shows a preferred embodiment of a mobile antenna unit of the invention. In FIG. 1, reference numeral 1 designates the front windshield of an automobile; 2, an antenna element in the form of a transparent sticker incorporating a copper foil 3, the antenna element being adhered to the inside of the front windshield 1; 4, one end of a coaxial cable; 5, the output terminal of the antenna element and the outer conductor of the coaxial cable, the end of which is connected to the vehicle body; 7, a front pillar of the automobile; and 12, a steering wheel.

Figure 2:
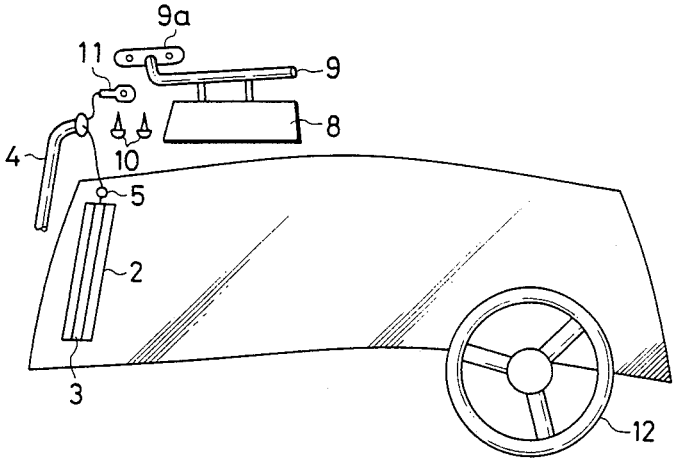
FIG. 2 is a diagram of the FIG. 1 embodiment as viewed from the driver's seat.

FIG. 2 shows the antenna unit of FIG. 1 as viewed from the driver's seat. In FIG. 2, those components which have been described with reference to FIG. 1 are therefore designated by the same reference numerals. In FIG. 2, reference numeral 9 identifies a sun visor; 9, a shaft about which the sun visor is turned; 9*a*, a base for securing the shaft 9 to the vehicle body; 10, attachment screws; and 11, a lug soldered to the end of the outside conductor of the coaxial cable. The lug 11 together with the base 9*a* is fixedly secured to the metal structure of the vehicle body with the screw 10 so that the coaxial cable is electrically grounded.

Figure 3A:
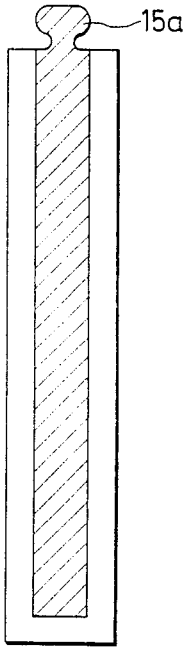
FIG. 3A is a diagram showing the structure of an antenna element.
Figure 3B:
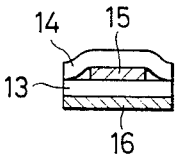
FIG. 3B is a sectional view of the same.
Figure 4:
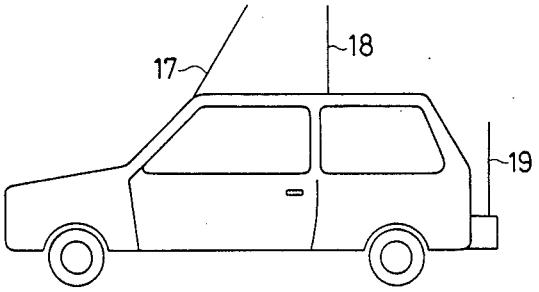
FIG. 4 PRIOR ART
FIG. 4 is a diagram showing an example of the installation of a conventional whip antenna.
Figure 5:
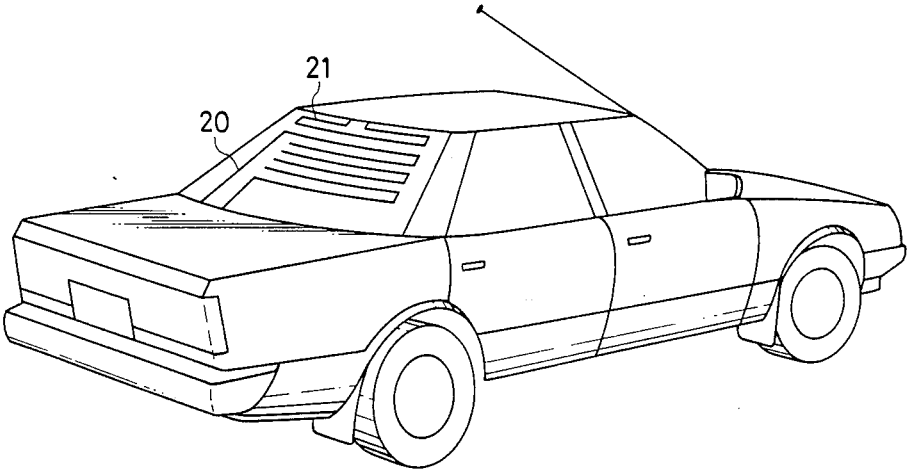
FIG. 5 PRIOR ART
FIG. 5 is a diagram showing a conventional windshield antenna.

FIGS. 3A and 3B show the structure of the antenna element 2 of FIG. 1 in more detail. Specifically, FIG. 3A is a plan view of the antenna element 2, and FIG. 3B a sectional view thereof. Transparent plastic films 13 and 14 are joined together, for instance, by thermocompressive bonding in such a manner that a conductive element 15 is held between the films 13 and 14. The outer surface of the film 13 is coated with an adhesive 16 so that the antenna element can be struck to the windshield. One end of the conductive element 15 is exposed so as to be used as the output terminal.

Figure 25:
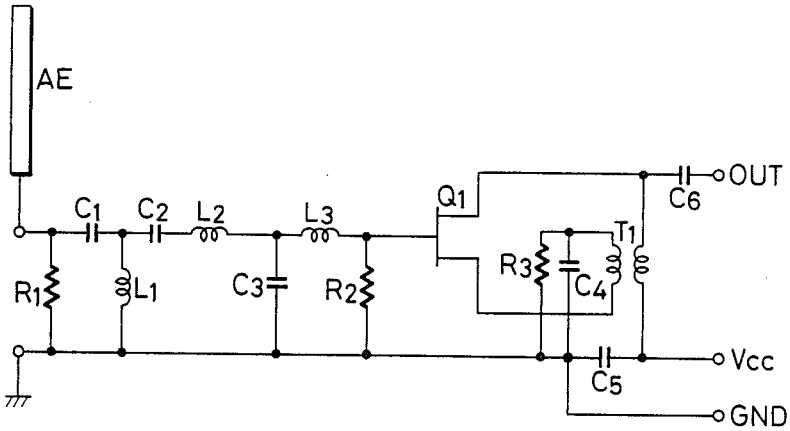
FIG. 25 is a circuit diagram showing an embodiment which uses a buffer amplifier.

FIG. 25 shows an example of a circuit in which a buffer amplifier is connected to the antenna element of the invention. In FIG. 25, AE designates the antenna element, and GND, a terminal to be connected to the vehicle body.

A circuit including circuit elements $C_1$ through $C_3$ and $L_1$ through $L_3$ can be divided into a high-pass filter composed of the circuit elements $C_1$, $C_2$ and $L_1$, and a low-pass filter composed of the circuit elements $L_2$, $L_3$ and $C_3$. The two filters together provide a bandpass characteristic in the FM broadcast band.

The principles of the antenna unit of the invention will be described with reference to FIGS. 6 through 9.

Figure 6:
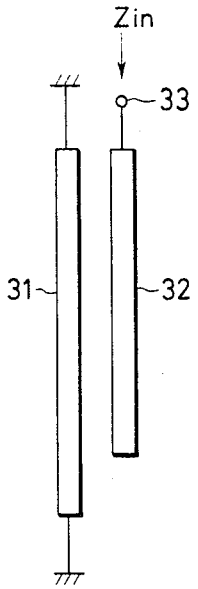
FIG. 6 is a diagram for a description of a preferred embodiment utilizing a strip line structure.

FIG. 6 is a diagram for a description of this preferred embodiment of the invention in which a parallel-coupled strip line structure is employed.

A pillar 31 of the automobile electrically appears as a strip line whose ends are connected to the vehicle body and a large-area metal part, namely, the roof which are at zero (ground) potential. An antenna element 32 disposed parallel to the pillar 31 is free at both ends. A connecting terminal 33 is connected to one of the two ends of the antenna element.

Figure 7:
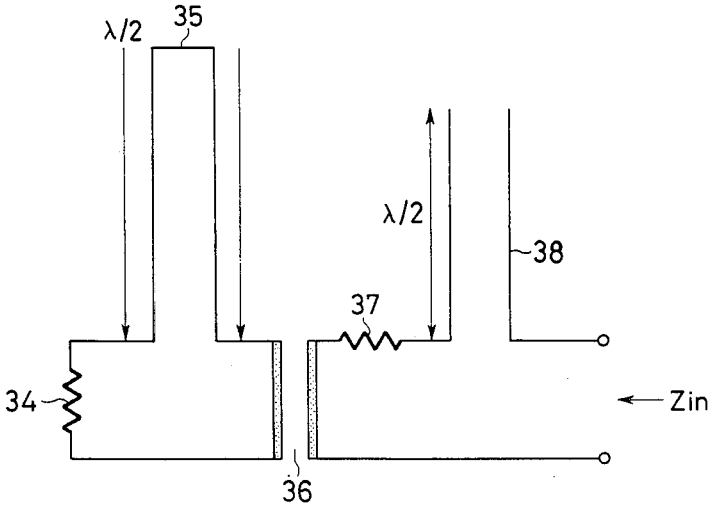
FIG. 7 is a distributed constant circuit diagram of the preferred embodiment.

The inventive antenna unit is shown schematically as a distributed constant circuit in FIG. 7. The pillar 31 in FIG. 6 has both ends grounded. Having an electrical length less than $\lambda/2$ ($\cong$1.8 mm) in the FM broadcast band, the pillar is inductive. Therefore, the pillar is expressed as an inductance 35 and a radiation resistance 34 in FIG. 7. The antenna element 32 in FIG. 6 is free at both ends and also has an electrical length less than $\lambda/4$. Therefore, the antenna is capacitive. Accordingly, the antenna element can be expressed electrically as a radiation resistance 37 and a capacitance 38. As shwon in FIG. 7, a transformer 36 is used to couple the pillar 31 and the antenna element 32.

Figure 8:
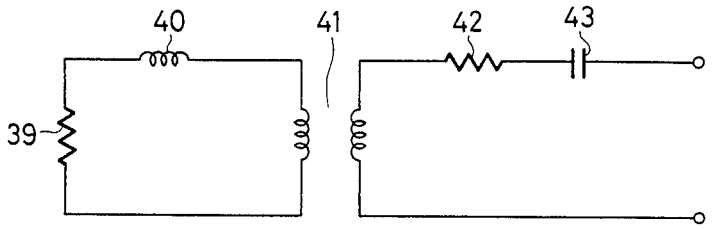
FIG. 8 is a lumped constant circuit diagram of the preferred embodiment.

The distributed constant circuit in FIG. 7 can be expressed as a lumped constant circuit as shown in FIG. 8. A radiation resistance 39, an inductance 40, a transformer 41, a radiation resistance 42 and a capacitance 43 in FIG. 8 correspond to the radiation resistance 34, the inductance 35, the transformer 36, the radiation resistance 37 and the capacitance 38 in FIG. 7, respectively.

Figure 9:
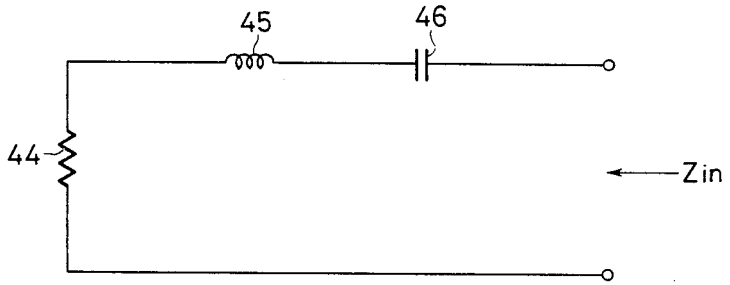
FIG. 9 is an equivalent circuit diagram of the preferred embodiment.
Figure 10A:
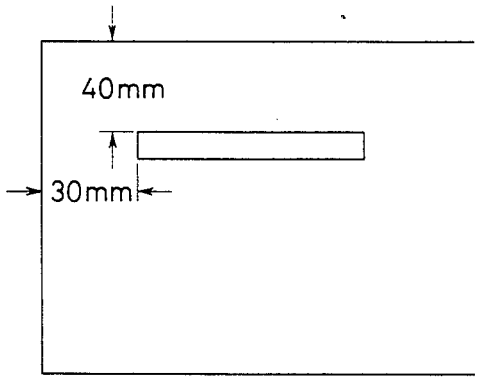
FIG. 10A PRIOR ART
FIG. 10A is a diagram showing the position of the antenna element.
Figure 10B:
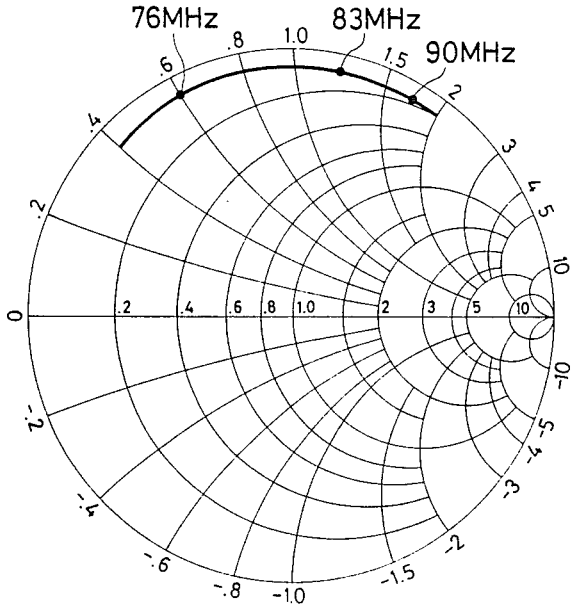
FIG. 10B PRIOR ART
FIG. 10B and FIGS. 11 and 12 are diagrams showing antenna impedance curves in the case where conventional antenna elements are horizontally mounted.
Figure 11:
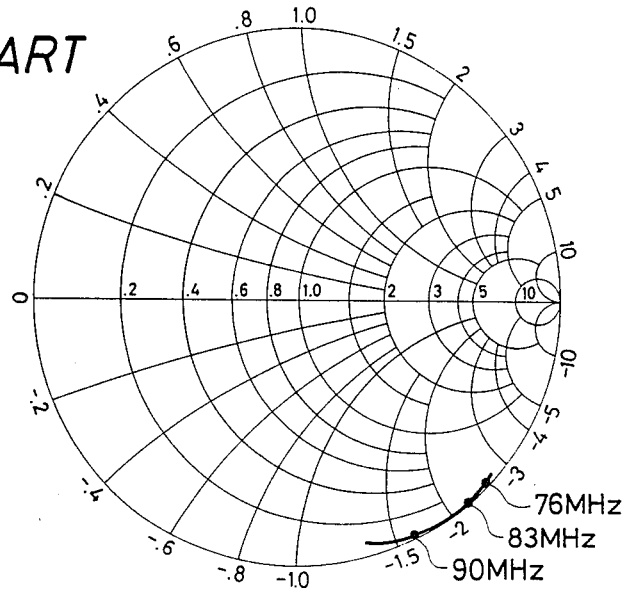
FIG. 11 PRIOR ART
Figure 12:
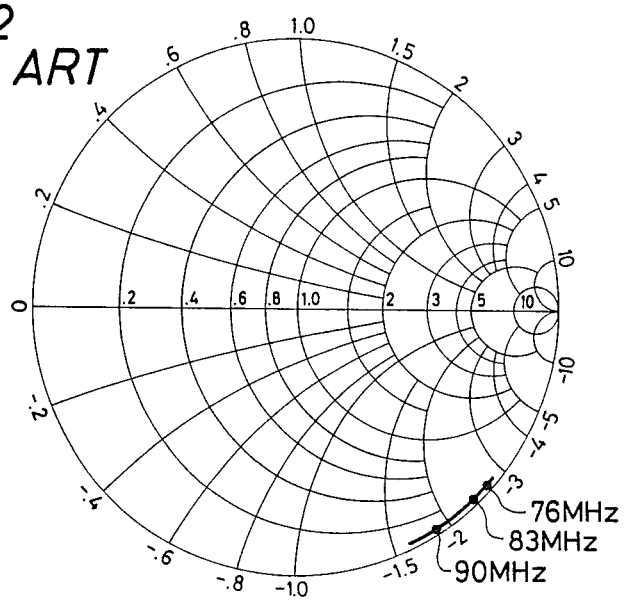
FIG. 12 PRIOR ART

FIG. 9 is the final equivalent circuit of the circuit in FIG. 8. That is, the circuit of the FIG. 8 can be equivalently represented by a series resonance circuit composed of a composite radiation resistance 44, a composite reactance, i.e., a composite inductance 45, and a capacitance 46.

That is, in the FM broadcast band, the pillar acts as inductance while the antenna element acts as capacitance, which indicates the possibility of having a resonance point in the FM band.

Next, the operation of the buffer amplifier circuit in FIG. 25 will be described.

Figure 27:
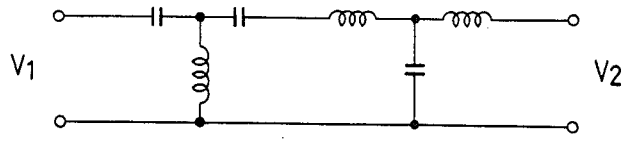
FIG. 27 is a circuit diagram showing a filter section of the buffer amplifier.

FIG. 27 shows the part of FIG. 25 from the output terminal of the antenna element AE to the gate of the transistor $Q_1$.

One of the characteristics of the circuit in FIG. 27 will be described. For simplification in calculation, it is assumed that $C_1=C_2=C$, $L_1=L$, $L_2=L_3=L'$, and $C_3=C'$.

The F parameter of this circuit can be calculated as follows:

$$(F)=\begin{pmatrix}1 & \frac{1}{j\omega C}\\ 0 & 1\end{pmatrix}\begin{pmatrix}1 & 0\\ \frac{1}{j\omega C} & 1\end{pmatrix}\begin{pmatrix}0 & \frac{1}{j\omega C}\\ 1 & 1\end{pmatrix}\times\begin{pmatrix}0 & j\omega L'\\ 1 & 1\end{pmatrix}\begin{pmatrix}1 & 0\\ j\omega C & 1\end{pmatrix}\begin{pmatrix}1 & j\omega L'\\ 0 & 1\end{pmatrix} \quad (1)$$

$$=\begin{pmatrix}1\frac{1}{\omega^2 LC} & \frac{1}{j\omega C} & 1 & \frac{1}{j\omega C}\\ \frac{1}{j\omega L} & 1 & 0 & 1\end{pmatrix}\times\begin{pmatrix}1-\omega^2 L'C' & j\omega L & 1 & j\omega L'\\ j\omega C' & 1 & 0 & 1\end{pmatrix}$$

$$=\begin{pmatrix}1-\frac{1}{\omega^2 LC} & \frac{1}{j\omega C}\left(2-\frac{1}{\omega^2 LC}\right)\\ \frac{1}{j\omega L} & 1-\frac{1}{\omega^2 LC}\end{pmatrix}\begin{pmatrix}1-\omega^2 L'C' & j\omega L'(2-\omega^2 L'C')\\ j\omega C' & 1-\omega^2 L'C'\end{pmatrix}$$

If the center frequency of the front stage high-pass filter is made equal to that of the rear stage low-pass filter, then:

$$\omega_0^2 LW-\omega_0^2 L'C'=1$$

Substitution into equation (1) gives:

$$F=\begin{pmatrix}0 & \frac{1}{j\omega C}\\ \frac{1}{j\omega L} & 0\end{pmatrix}\begin{pmatrix}0 & j\omega L'\\ j\omega C' & 0\end{pmatrix}$$

$$=\begin{pmatrix}C/C & 0\\ 0 & L'/L\end{pmatrix}$$

$LC=L'C'$, as described above. Therefore, with $L'/L=C/C'=n$, $$(F)=\begin{pmatrix}1/n & 0\\ 0 & n\end{pmatrix} \quad (2)$$

Figure 28:
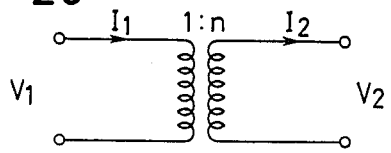
FIG. 28 is a circuit diagram showing an ideal transformer.

If, in the ideal transformer shown in FIG. 28, the ratio of the numbers of turns of the secondary winding to that of the primary winding is n, then the following equations can be written:

$$V_2=nV_1 \text{ and } I_2=(1/n)=I_1$$

Expressed in matrix form:

$$\begin{pmatrix}V_1\\ I_1\end{pmatrix}=\begin{pmatrix}1/n & 0\\ 0 & n\end{pmatrix}\begin{pmatrix}V_2\\ I_2\end{pmatrix}=(F)\begin{pmatrix}V_2\\ I_2\end{pmatrix}$$

As is apparent from a comparison of this expression with equation (2), it is theoretically possible for the circuit of FIG. 27 to provide an output voltage higher than the input.

Figure 29:
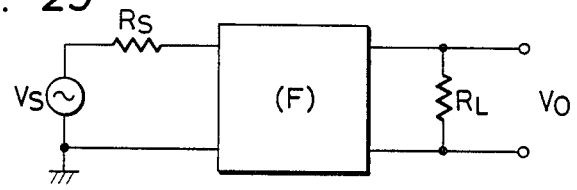
FIG. 29 is a circuit diagram showing a load connected to the filter section of the preferred embodiment.

In the case where a signal source impedance $R_S$ and a load impedance $R_L$ are connected to the circuit of FIG. 27 as shown in FIG. 29, the F parameter (F') is:

$$(F')=\begin{pmatrix}1 & R_L\\ 0 & 1\end{pmatrix}\begin{pmatrix}\frac{1}{n} & 0\\ 0 & n\end{pmatrix}\begin{pmatrix}1 & 0\\ \frac{1}{R_L} & 1\end{pmatrix}$$

$$=\begin{pmatrix}\frac{1}{n}+n\frac{R_S}{R_L} & nR_S\\ \frac{n}{R_L} & n\end{pmatrix}=\begin{pmatrix}A' & B'\\ C' & D'\end{pmatrix}$$

Figure 30:
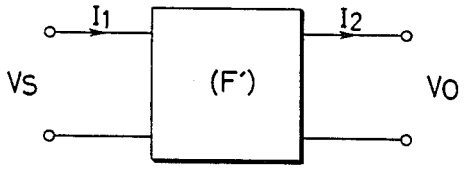
FIG. 30 is a circuit diagram for the case where loads are represented parametrically.

Then, the circuit of FIG. 29 can be expressed as shown in FIG. 30. For this circuit, the voltage gain $G_e$ is:

$$G_e=\frac{V_O}{V_S}-\frac{1}{A'}=\frac{1}{\frac{1}{n}+\frac{R_S}{R_L}}$$

If $R_S/R_L$ is constant, for $n=R_L/R_S$, $G_e$ is a maximum. At that point, the voltage gain $G_{e\,max}$ is as follows:

$$G_{e\,max}=(\tfrac{1}{2})\sqrt{\frac{R_S}{R_L}}$$

Therefore, in the case where an antenna having a signal source impedance of 75 ohms is connected to this circuit and the output section of the circuit is terminated with 300 ohms, then:

$$G_e=(\tfrac{1}{2})\sqrt{\frac{300}{75}}=1$$

If a 75-ohm load is connected directly to an antenna having a 75-ohm signal source impedance, a voltage which is half of the signal source voltage is developed across the load. Therefore, the voltage obtained in the former case is twice as high as the voltage in the latter case.

Now, the circuit of the transistor $Q_1$ will be described. The transistor $Q_1$ is a field-effect transistor (FET) having its drain output coupled to its source, in a negative feedback arrangement, through a transformer having a turns ratio of 1:1, the gain being one. However, the transistor provides a low output impedance, similar to a conventional transistor-emitter follower circuit, thus forming a buffer amplifier having a low NF (noise figure) and wide dynamic range.

In the circuit of FIG. 25, a filter section including the capacitors $C_1$ through $C_3$ and the inductors $L_1$ through $L_3$ boosts the input voltage, and a constant output impedance circuit formed by the transistor $Q_1$ is connected to the filter section. Therefore, if the input and output impedances of the filter section are 75 ohms and 300 ohms, respectively, as described above, a gain of about 6 dB is obtained.

The filter section can also block a surge voltage induced when the antenna is struck by lighting.

As described before, in the FM broadcast band, the pillar of an automobile acts as an inductive element while a conductor shorter than a quarter wavelength acts as a capacitive element. Therefore, by disposing the two elements at positions where they are in an inductive relation to each other, resonance (tuning) occurs in the receiving band. Realization of this and conditions therefor will be described by reference to experimental data.

Figure 13A:
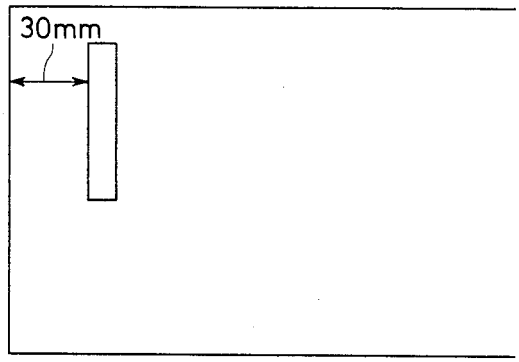
FIG. 13A is a diagram showing the position of the antenna element.
Figure 13B:
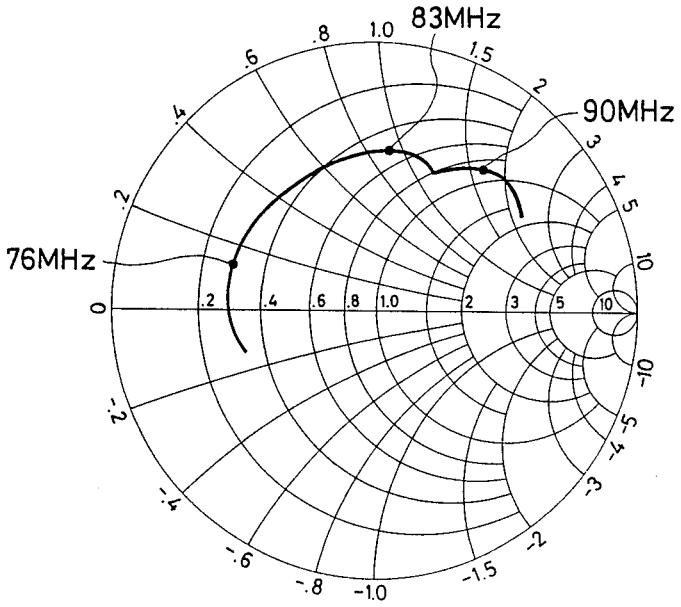
FIG. 13B and FIGS. 14 through 18 are diagrams showing impedance curves of antenna elements according to the invention.
Figure 14:
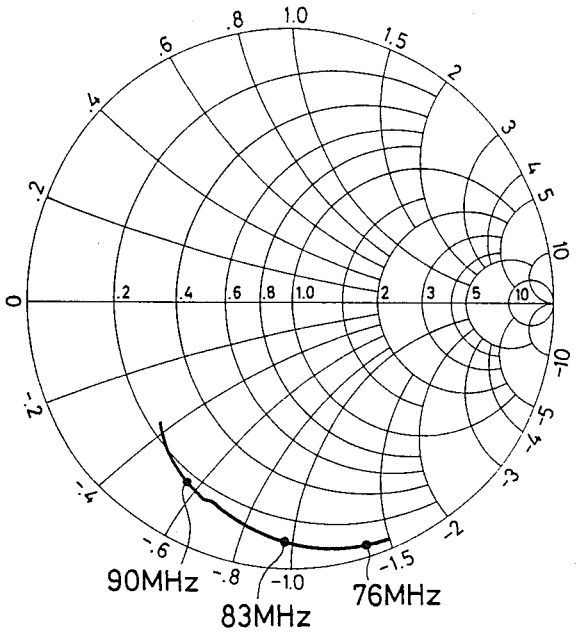
Figure 15:
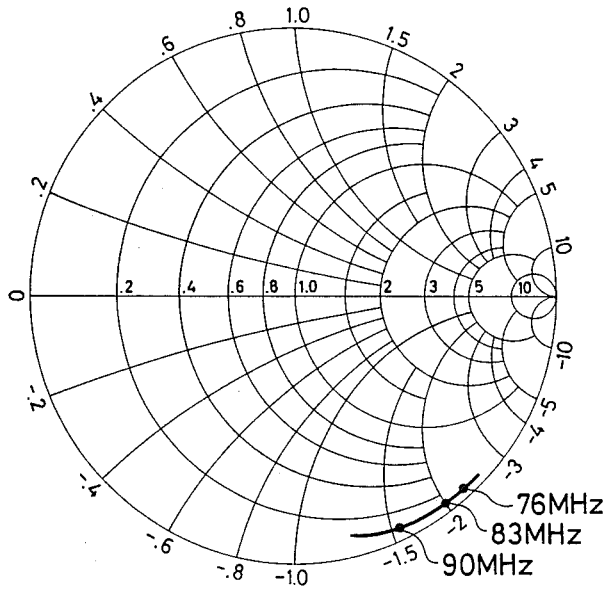

FIGS. 13B, 14 and 15 show measurement values obtained for an antenna element mounted vertically at a distance 30 mm from the front pillar, as shown specifically in FIG. 13B. The upper end of the element is set substantially near the upper edge of the front windshield. The data shown in FIGS. 13B, 14 and 15 is for antenna elements whose lengths are ¼, 1/7 and ⅛ wavelengths, respectively. In the case of the antenna element of ¼ wavelength, the curve crosses the fundamental axis, thus showing the phenomenon of resonance.

In the case of the antenna element whose length is ¼ wavelength, the antenna element was in bent the form of the character "J". That is, since the vertical length of the windshield is limited, the antenna element was bent at right angles 60 cm from the upper edge of the windshield and then further bent upwardly. The distance between the parallel parts of the antenna element thus bent was 10 mm at the edge section.

Figure 16:
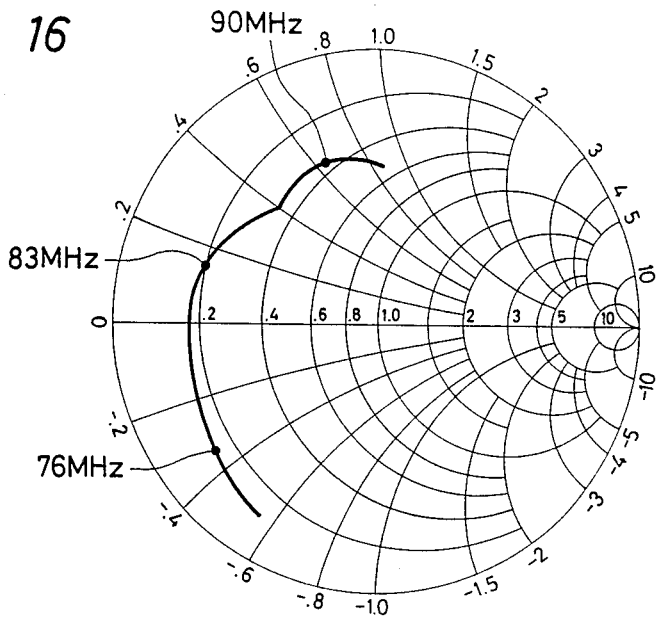
Figure 17:
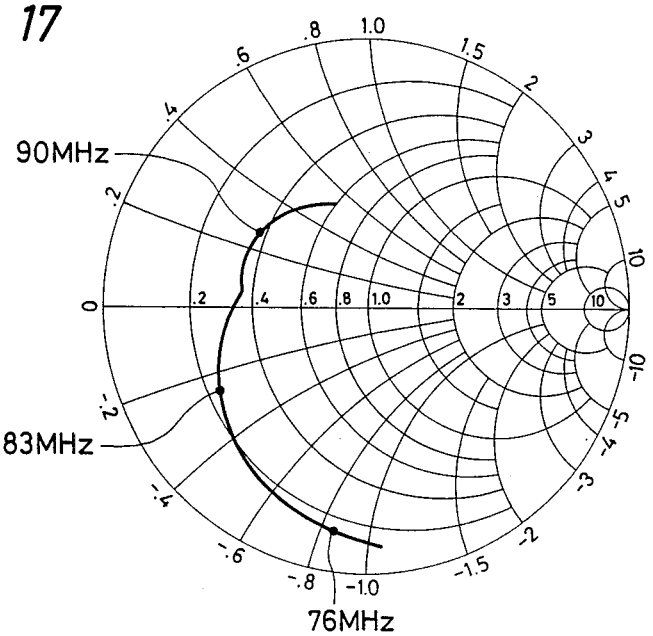

FIG. 16 shows measurement values obtained when the length of the antenna element was 1/6 wavelength (60.2 cm). FIG. 16 shows measurement values obtained when the length of the antenna element was of the same value and the width of the copper foil was changed from 10 mm to 5 mm.

Figure 18:
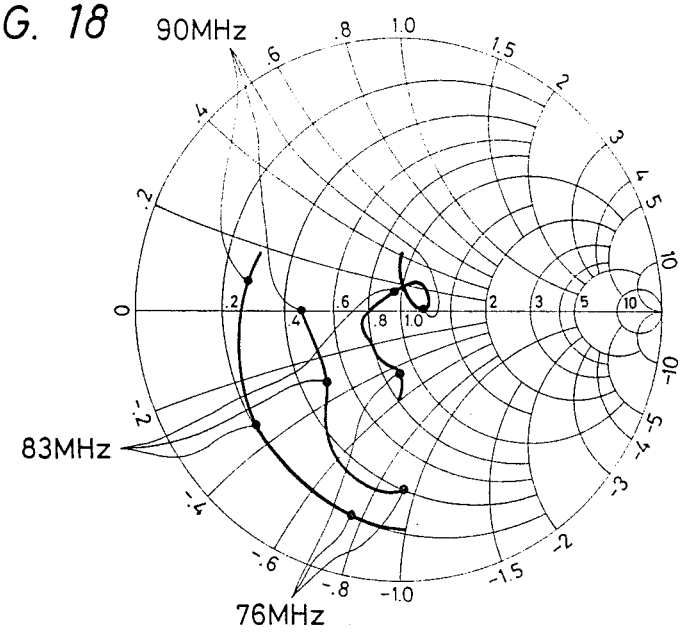
Figure 19:
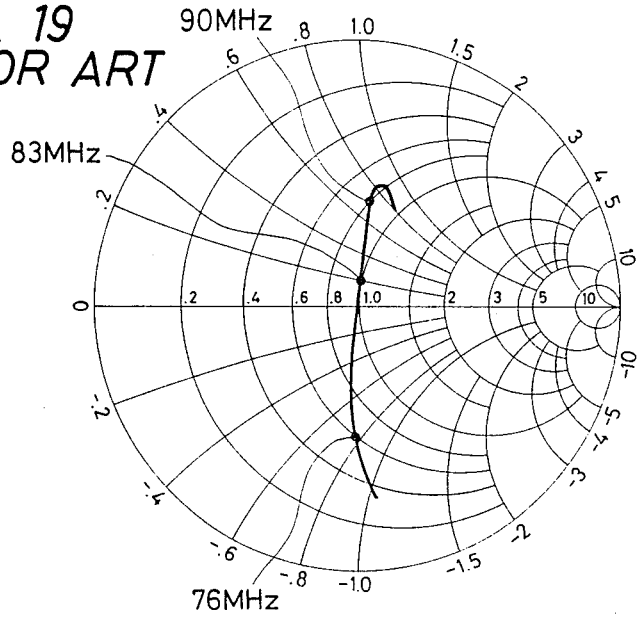
FIG. 19 PRIOR ART
FIG. 19 is a diagram showing an impedance curve of a conventional whip antenna.

FIG. 18 shows measurement values obtained when the copper foil was 10 mm in width, the length of the antenna element was 1/6 wavelength. In this case, the distance between the pillar and the antenna element was varied. The data indicated is for the cases of D=30 mm, 55 mm and 110 mm from the outside of the chart. As is apparent from FIG. 18, for D=110 mm, the antenna impedance was very close to the coaxial cable impedance.

As is apparent from the above description, if an antenna element whose length is ¼ wavelength or less is disposed near the pillar, even if its length is substantially less than ¼ wavelength, resonance occurs in the standard FM receiving band, and the antenna impedance can be made close to the coaxial cable impedance (depending somewhat on the type of automobile and the shape of the antenna element).

Figure 26:
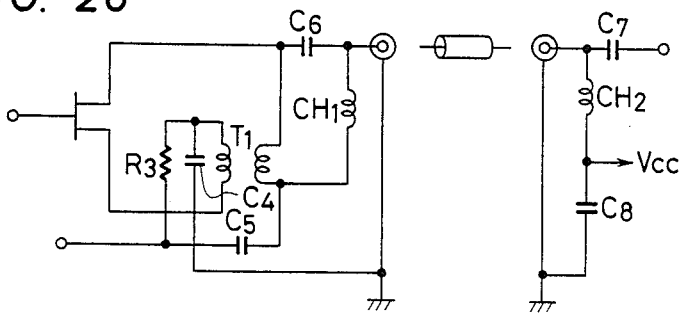
FIG. 26 is a circuit diagram showing an example of the energization of the buffer amplifier.

It is apparent from FIG. 18 that a 75-ohm coaxial cable can be connected directly to the output terminal of the antenna. However, connection of the antenna to the antenna input circuit of the receiver through a buffer amplifier as shown in FIG. 26 can prevent the loss caused by the mismatching of impedances attributed to the variation of antenna impedance in the receiving band.

If a buffer amplifier is used, it is desirable that the buffer amplifier circuit be accommodated in a small box located near the output terminal fo the antenna and that the ground terminal of the circuit be connected to a metal part of the vehicle body near the output terminal of the antenna element, similar to the case where the antenna is directly connected.

In the circuit of FIG. 25, a line for applying a supply voltage Vcc to the buffer amplifier must be provided in addition to the signal lines. On the other hand, in the circuit of FIG. 26, the buffer amplifier is connected through a coaxial cable to the receiver so that the supply voltage is applied through the signal lines, with the result that the number of lead wires is reduced. In FIG. 26, $C_6$ and $C_7$ designate DC-blocking capacitors, and $CH_1$ and $CH_2$, signal blocking choke coils.

Figure 24:
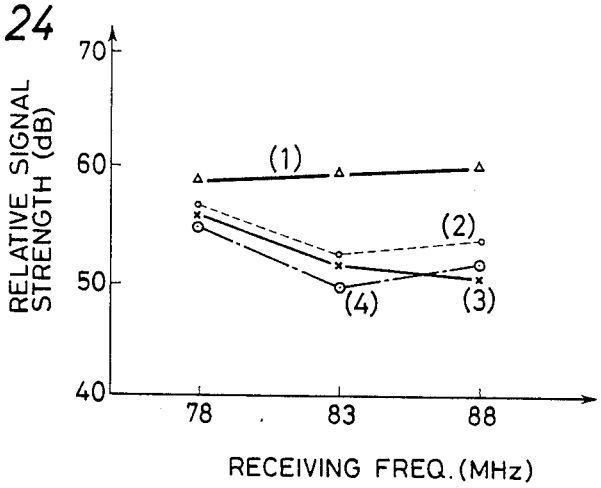
FIG. 24 is a diagram for a comparison of the sensitivity of the antenna of the invention with those of conventional antennas.

In FIG. 24, the sensitivity of the antenna according to the invention is compared with those of conventional whip-type antennas. The data here presented was measured under the condition that no buffer amplifier was used.

The measurements were carried out in such a manner that a signal transmitting test antenna input value required for the receiver's detection output to reach 30 dB in S/N ratio was measured for each of three frequencies in the FM broadcast band.

In the graph of FIG. 24, the lower in position the plotted curve, the higher the sensitivity of the antenna (the antenna having its characteistic curve plotted in the lowest position has the highest sensitivity). In FIG. 24, (1) designates the characteristic curve of a whip antenna mounted on the pillar of the automobile, the antenna being 90 cm in length; (2), the characteristic curve of an antenna according to the invention; (3), the characteristic curve of a 90-cm whip antenna installed on the roof of the automobile; and (4), the characteristic curve of a whip antenna of a length of 138 cm.

It is apparent from the graph that the sensitivity of the antenna according to the invention is substantially equal to that of a good conventional whip antenna.

Figure 20:
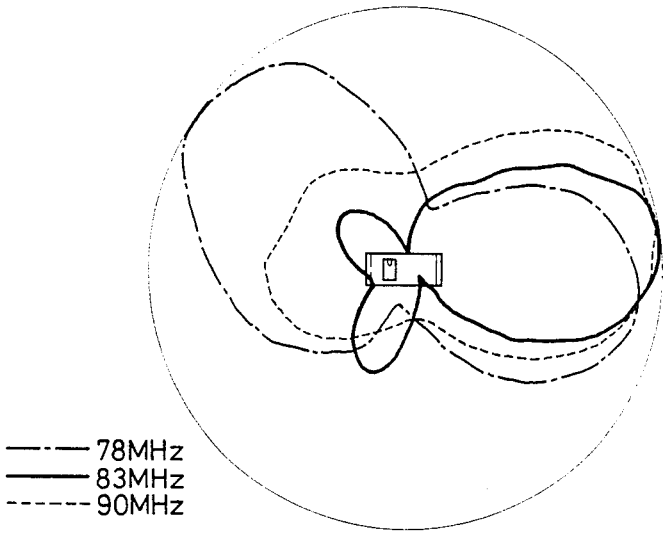
FIG. 20 is a diagram showing a directional pattern of the preferred embodiment for vertically polarized reception.
Figure 21:
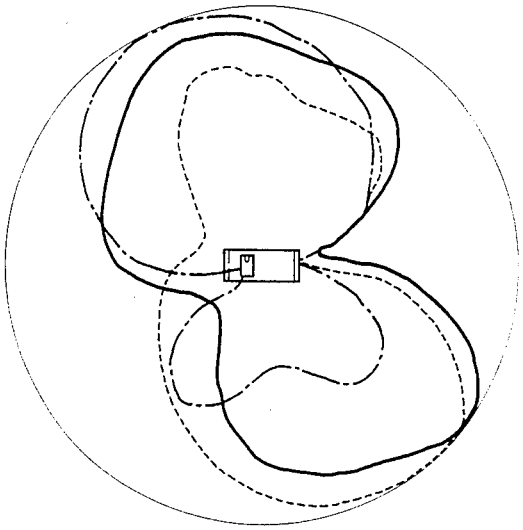
FIG. 21 is a diagram showing a directional pattern of the preferred embodiment for horizontally polarized reception.
Figure 22:
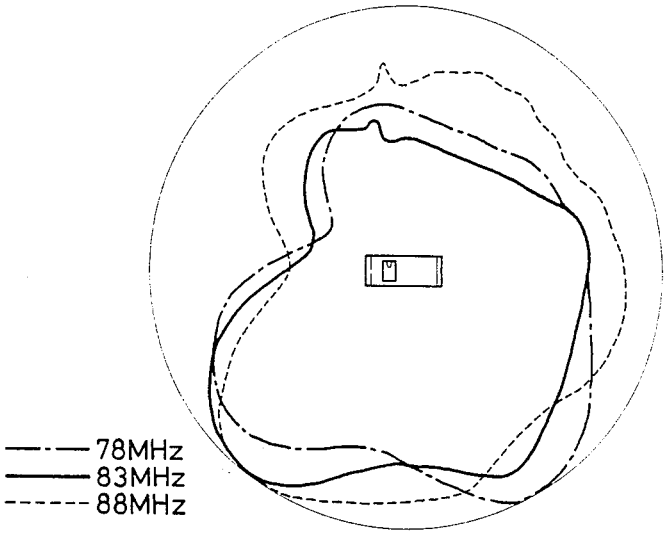
FIG. 22 PRIOR ART
FIG. 22 is a diagram showing a directional pattern of a conventional whip antenna for vertically polarized reception.
Figure 23:
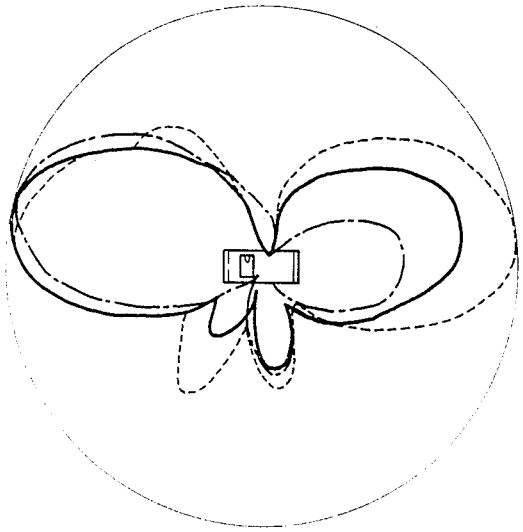
FIG. 23 PRIOR ART
FIG. 23 is a diagram showing a directional pattern of the conventional whip antenna for horizontally polarized reception.

FIGS. 20 and 21 show the directional patterns of the antenna of the invention which, similar to the cases of FIGS. 22 and 23, were obtained for the cases where the signal transmitting antenna was a vertically polarized antenna and when it was a horizontally polarized wave.

Figure 31:
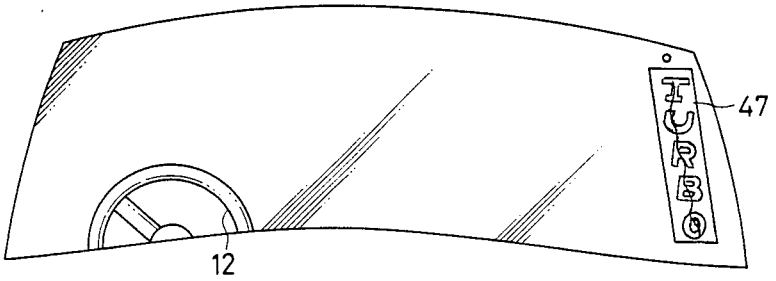
FIG. 31 is a diagram showing another example of an antenna element according to the invention.

FIG. 31 shows another example of a mobile antenna unit according to the invention. Although in the above-described examples, the antenna element has the form of an elongated metal foil or wire, in this example the antenna element is made up of conductive figures or characters connected with a thin conductive material. If the total length of the figures or characters is equal to a predetermined value, then it can be made to have the same performance as an ordinary antenna.

The antenna element may be formed by connecting separate figures with conductive material as described above. However, the antenna element may be in the form of a pattern such as a picture drawn with a single stroke of the brush. In this case, the antenna element can be formed by punching a metal foil.

Conventional methods may be employed in combination to make the figure or figures conspicuous. For instance, the figure or figures can be made conspicuous by printing them in color, or instead of colorless transparent films, colored films can be used, or portions other than the figures can be printed in a color different from the color of the figures so that the figures are conspicuous in contrast. An antenna element using the colorless transparent films is advantageous through in that portions other than the figures will not be an obstruction in the driver's field of vision.

As is apparent from the above description, in accordance with the invention, based on the fact that in the FM broadcast band the pillar of an automobile acts as an inductive element while an antenna element whose length is smaller than a ¼ wavelength appears as a capacitance, the antenna element is disposed near the pillar to cause a mutual action therebetween thereby to achieve resonance in the receiving band. The use of an antenna element shorter than ¼ wavelength inside the automobile provides the same performance as that of a ¼ wavelength whip antenna mounted on the outside of the automobile. The installation of the antenna unit according to the invention can be readily achieved.

If the configuration of the antenna element is formed by combining characters and/or figures as described above, the element can serve not only as antenna, but also as other means, for instance, for indicating the automobile owner's name or displaying a certain message without using additional spaces.

We claim:

1. In a mobile antenna unit installed on a vehicle which has a pillar with a conductive part of metal on the side of a window glass plate, wherein the improvement comprises: an antenna whose effective electrical length is less than a fourth of the wavelength of a receiving radio wave and which is mounted on a surface of said glass plate a predetermined distance from said pillar, said antenna having first and second end points defining said electrical length with one of said first and second end points being an output terminal, and a line connecting said first and second end points being substantially parallel to said pillar, so that said pillar acts as an inductance and said antenna acts as a capacitance to achieve resonance in a predetermined receiving band, and a ground terminal of a means connected to receive a signal from said antenna being connected to a body of said vehicle near said output terminal of said antenna.

2. The mobile antenna unit of claim 1, wherein said antenna is mounted a distance from said pillar such that said antenna resonates at a frequency within a standard FM broadcast band.

3. The mobile antenna of claim 2, wherein said antenna comprises a transparent sticker incorporating a conductive foil.

4. The mobile antenna unit of claim 3, wherein said antenna comprises two transparent plastic films joined together by thermocompression with said conductive foil held between said plastic films.

5. The mobile antenna unit of claim 4, further comprising an adhesive coated on an outer surface of one of said transparent plastic films.

6. The mobile antenna unit of claim 3, wherein at least one of said plastic films is colored.

7. The mobile antenna unit of claim 3, wherein said foil is cut in a J shape.

8. The mobile antenna unit of claim 2, further comprising a buffer amplifier for amplifying an output signal from said antenna.

9. The mobile antenna unit of claim 8, further comprising a box for mounting said buffer amplifier near an output terminal of said antenna.

10. The mobile antenna unit of claim 1, wherein said window glass plate is a front window.

11. The mobile antenna unit of claim 1, wherein said window glass plate is a side window.

12. The mobile antenna unit of claim 1, wherein said window glass plate is a rear window.

13. The mobile antenna unit of claim 1, wherein said means connected to receive a signal from said antenna is a coaxial cable.

14. The mobile antenna unit of claim 1, wherein said means connected to receive a signal from said antenna is an impedance changing means.

15. The mobile antenna unit of claim 1, wherein the entire length of said antenna is parallel to said pillar.

16. A mobile antenna unit, for installation on a vehicle having a pillar with a conductive part of metal on the side of a glass window, comprising:

an antenna comprising a transparent sticker, said sticker incorporating a conductive foil cut in the shape of a predetermined pattern, said pattern extending along an axis substantially parallel to said pillar, the effective electrical length of said pattern being less than one fourth of the wavelength of a receiving radio wave.

and said antenna being mounted on a surface of said glass plate a predetermined distance from said pillar so that said pillar acts as an inductance and said antenna acts as a capacitance to achieve resonance in a predetermined receiving band, and a ground terminal of a means connected to receive a signal from said antenna being connected to a body of said vehicle near an output terminal of said antenna.

17. The mobile antenna unit of claim 16, wherein said predetermined pattern is an alphanumeric character.

* * * * *